US011155445B2

(12) United States Patent
Jensen et al.

(10) Patent No.: US 11,155,445 B2
(45) Date of Patent: Oct. 26, 2021

(54) LIFTING ASSEMBLY FOR LIFTING HEAVY LOADS

(71) Applicant: Siemens Gamesa Renewable Energy A/S, Brande (DK)

(72) Inventors: Jens Hald Jensen, Give (DK); Jesper Bjerre Pedersen, Torring (DK); Jeppe Soee, Ronde (DK)

(73) Assignee: SIEMENS GAMESA RENEWABLE ENERGY A/S, Brande (DK)

( * ) Notice: Subject to any disclaimer, the term of this patent is extended or adjusted under 35 U.S.C. 154(b) by 228 days.

(21) Appl. No.: 16/348,292

(22) PCT Filed: Oct. 10, 2017

(86) PCT No.: PCT/EP2017/075735
§ 371 (c)(1),
(2) Date: May 8, 2019

(87) PCT Pub. No.: WO2018/086811
PCT Pub. Date: May 17, 2018

(65) Prior Publication Data

US 2020/0062551 A1 Feb. 27, 2020

(30) Foreign Application Priority Data

Nov. 11, 2016 (DE) ..... 102016222211.2

(51) Int. Cl.
*B66C 1/10* (2006.01)
*B66C 1/66* (2006.01)

(52) U.S. Cl.
CPC ..... *B66C 1/108* (2013.01); *B66C 1/66* (2013.01)

(58) Field of Classification Search
CPC ..... B66C 1/108; B66C 1/66; B66C 1/10
(Continued)

(56) References Cited

U.S. PATENT DOCUMENTS 3,822,077 A * 7/1974 Palen ..... B66C 1/223 294/81.21
3,955,844 A * 5/1976 de Castella ..... B66C 1/105 294/67.1
(Continued)

FOREIGN PATENT DOCUMENTS

CN 103159127 A 6/2013
CN 104261242 A 1/2015
(Continued)

OTHER PUBLICATIONS

DE 102014017550A1, English Machine Translation, 8 pages. Jun. 2016.*
(Continued)

*Primary Examiner* — Paul T Chin
(74) *Attorney, Agent, or Firm* — Schmeiser, Olsen & Watts LLP

(57) ABSTRACT

Provided is a lifting assembly for lifting a load, including an upper part and a number of independent lower parts, wherein the upper part includes a lifting beam, a suspension arrangement for suspending the lifting beam from a crane hook, and a locking assembly including an actuator arrangement realized to engage the upper part to a lower part; and wherein a lower part includes a lifting tool realized for connection to a load, and a locking interface realized to engage with the locking assembly of the upper part. A method of lifting a load using such a lifting assembly is also provided.

12 Claims, 8 Drawing Sheets

(58) Field of Classification Search
USPC ..... 294/67.1, 67.5, 81.3
See application file for complete search history.

(56) References Cited

U.S. PATENT DOCUMENTS

| | | | | |
|---|---|---|---|---|
| 6,048,012 | A * | 4/2000 | Selby | B66C 1/105 294/67.5 |
| 7,891,718 | B2 * | 2/2011 | Heinaman | B66C 1/105 294/81.3 |
| 8,000,835 | B2 * | 8/2011 | Friz | B66C 13/04 700/230 |
| 9,140,404 | B1 * | 9/2015 | Akrep | B66C 1/10 |
| 2010/0176613 | A1 * | 7/2010 | Huecker | B66C 1/10 294/67.5 |
| 2011/0211903 | A1 | 9/2011 | Ramun et al. | |
| 2013/0147218 | A1 | 6/2013 | Steffensen | |
| 2014/0073477 | A1 | 3/2014 | Buchan et al. | |
| 2014/0341742 | A1 * | 11/2014 | Knoop | F03D 1/0691 416/215 |
| 2015/0023790 | A1 | 1/2015 | Friis | |
| 2017/0334685 | A1 | 11/2017 | Kersten et al. | |

FOREIGN PATENT DOCUMENTS

| | | | |
|---|---|---|---|
| CN | 105197768 | A | 12/2015 |
| DE | 102013109935 | A1 | 3/2014 |
| DE | 102014017550 | A1 | 6/2016 |
| DE | 102014225336 | A1 | 6/2016 |
| EP | 2873641 | A1 | 5/2015 |
| EP | 3034450 | A1 | 6/2016 |
| WO | 2005113405 | A1 | 12/2005 |
| WO | 2006076920 | A1 | 7/2006 |

OTHER PUBLICATIONS

Non-English Chinese Office Action for Application No. 201780069843.9, dated Nov. 27, 2019.

International Search Report for application No. PCT/EP2017/075735 dated Jan. 30, 2018.

* cited by examiner

LIFTING ASSEMBLY FOR LIFTING HEAVY LOADS

CROSS-REFERENCE TO RELATED APPLICATIONS

This application claims priority to PCT Application No. PCT/EP2017/075735, having a filing date of Oct. 10, 2017, based on German Application No. 10 2016 222 211.2, having a filing date of Nov. 11, 2016, the entire contents both of which are hereby incorporated by reference.

FIELD OF TECHNOLOGY

The following relates to a lifting assembly for lifting a load, and a method of lifting a load using such a lifting assembly.

BACKGROUND

During manufacture, transport and assembly of a large structure such as a wind turbine, it may be necessary to lift and handle various components. For example, large components may be lifted by crane from one location to another during the manufacturing stage, from a manufacturing facility to a transport facility, from a transport facility to an installation site, etc. During assembly and installation it may be necessary to lift a component such as a wind turbine nacelle unit to a higher level, for example to mount a nacelle unit on a tower.

In the known handling methods, the diversity of wind turbine components in weight and shape has required different sets of lifting equipment for the different types of load. In the installation of a wind turbine, different lifting fittings are required for each kind of lifting procedure. These purpose-built or custom lifting fittings, including all control modules and guide wires, are individually designed for the specific load to be lifted. A dedicated rigging setup is also required for the attachment of each lifting fitting to the crane hook and for the attachment of guide-lines and other control means. Having to manufacture custom tools and solutions significantly adds to the overall cost of manufacture and assembly. Furthermore, every time that one kind of lifting fitting must be detached from the crane hook so that another kind of lifting fitting can be attached will increase the risk of accident or damage. The necessity of adhering to safety procedures increases the overall length of time that is needed for these handling procedures, thereby also adding to the overall costs.

SUMMARY

An aspect relates to a more efficient way of handling different kinds of load.

According to the embodiment of the invention, the lifting assembly comprises an upper part and a number of independent lower parts. The upper part comprises a lifting beam, a suspension arrangement for suspending the lifting beam from a crane, and a locking assembly comprising an actuator arrangement realized to engage the upper part to one of the lower parts. The lower part comprises a lifting tool realized for connection to a load, and a locking interface realized to engage with the locking assembly of the upper part.

An advantage of the lifting assembly according to the embodiment of the invention is that it allows significant cost savings to be achieved in the manufacture, transport and installation of structures or machines that involve various different kinds of components that need to be moved and lifted. The upper part of the lifting assembly is used at all times, while the various kinds of lower parts are only used as required. Each lower part can be shaped to carry a specific kind of load, so that each lower part can take into account any specific requirements of that load—for example a requirement to avoid any damage to an outer surface of the load; a requirement to engage with a specific part of the load, etc.

The inventive lifting assembly effectively separates the technically advanced upper part (which can be equipped with a controller and guide system) from the relatively simple lower part, and allows a quick and straightforward interface between the upper and lower parts.

According to the embodiment of the invention, the method of lifting a load using such a lifting assembly comprises at least the steps of selecting a lower part according to the load to be lifted; engaging the locking interface of the lower part to the locking assembly of the upper part; connecting a lifting tool of the lower part to the load; attaching the suspension arrangement of the upper part to a crane hook. These steps need not be carried out in the order given, but may be carried out in any suitable order.

The inventive method allows a rapid and safe exchange of lower parts of the lifting assembly during a handling procedure involving several different kinds of load. Being able to perform the "handover" from one type of load to another in a quick and safe manner can significantly reduce the overall costs, for example when a single crane is being used in the assembly and installation of a wind turbine.

In the following, without restricting the embodiment of the invention in any way, it may be assumed that the load to be lifted is a large and heavy component such as a wind turbine component. The heavy components of a wind turbine such as nacelle units, rotor blades etc. must often be lifted and moved during the manufacturing stages at the manufacturing facilities, during transport procedures by road, rail or ship, and during a final installation procedure at the wind turbine site.

As explained above, the advantage of the inventive lifting assembly is that only one upper part is needed, and this can be combined with any suitable lower part, depending on the type of load to be lifted. The upper part can remain attached to the hook of a crane or other lifting/hoisting apparatus that is being used to hoist and move various different types of load, and can also remain attached to a tag line system used to control the movements of a load during a lifting/hoisting procedure.

Whenever a different load is to be lifted, it is only necessary to exchange the lower parts. The inventive lifting assembly allows this exchange to be performed quickly and safely.

The locking assembly of the upper part is realized to engage securely with the locking interface of a lower part. In a particularly preferred embodiment of the invention, the locking interfaces of a plurality of lower parts are all constructed in an identical fashion. The actuator arrangement that engages the locking assembly to a locking interface can be realized in any suitable manner. It may be manually operable or may be at least partially automated.

In a preferred embodiment of the invention, the actuator arrangement comprises a number of linear actuators, and the locking interface is realized to engage with the linear actuators. For example, in a preferred embodiment of the invention, the actuator arrangement comprises a number of linear actuators arranged to extend horizontally in one direction, and a number of linear actuators arranged to extend horizontally in the opposite direction. A linear actuator is preferably cylindrical in shape and constructed from sufficiently strong material such as steel, since the arrangement of linear actuators must bear at least part of the load being carried. In a particularly preferred embodiment of the invention, the actuator arrangement comprises a hydraulic cylinder unit with at least two hydraulic cylinders. In this case, a linear actuator is a piston rod that can be extended or retracted by appropriately actuating its hydraulic cylinder. Alternatively, the actuator arrangement might comprise a worm drive arrangement, in which case a linear actuator is a worm screw that can be extended or retracted by appropriately actuating a worm wheel. The terms "linear actuator" and "rod" may be used interchangeably in the following. Regardless of the type of actuator arrangement, the lifting assembly preferably comprises a driver module arranged to drive the actuator arrangement in response to a control signal received from a remote control unit.

Each rod can extend into a suitably shaped region of the locking interface in order to effect a secure engagement of the locking interface with the locking assembly. This can be achieved in any number of ways. In one preferred embodiment, the locking assembly is mounted to the lifting beam and comprises side plates arranged to contain the actuator arrangement. The side plates comprise through-holes arranged to accommodate the rods, so that each rod can extend through a corresponding through-hole. The locking interface comprises complementary side plates arranged to accommodate the locking assembly. These side plates also comprise through-holes arranged to match the through-holes of the locking assembly and to accommodate the rods. In this embodiment, each rod extends through a pair of aligned through-holes.

Preferably, the actuator arrangement comprises at least two, more preferably at least four linear actuators arranged in a horizontal plane so that one set of linear actuators extends horizontally outward in one direction, and another set of linear actuators extends horizontally outward in the opposite direction. In a particularly preferred embodiment of the invention, the actuator arrangement is a hydraulic cylinder unit with six hydraulic cylinders arranged three on each side, so that three piston rods extend through matching through-holes in the side walls of the locking assembly and locking interface on one long side of the lifting beam, and three piston rods extend through matching through-holes in the side walls of the locking assembly and locking interface on the opposite long side of the lifting beam.

As indicated above, various kinds of lower parts can be provided for lifting various kinds of load. In a preferred embodiment of the invention, a lower part comprises a lifting tool realized for connection to a wind turbine nacelle unit. Such a lifting tool can comprise a long beam with a length comparable to the distance between the hub and the back of the nacelle. Different tool attachments are preferably provided on this embodiment of the lower part in order to be attached at suitable locations in or on the nacelle unit.

In a further preferred embodiment of the invention, a lower part comprises a lifting tool realized for connection to a wind turbine rotor blade. Such a lifting tool can also comprise a long beam, preferably about half as long as the blade, and with suitable tool attachments arranged to engage with the rotor blade at various positions and without damaging the outer surface of the rotor blade.

In a further preferred embodiment of the invention, a lower part comprises a lifting tool realized for connection to a wind turbine generator front end. Such a lifting tool can comprise a curved arm shaped to engage with the generator front end in its central region, so that the generator front end can be lifted into place for mounting at the front end of a nacelle. A similar lower part can be provided for lifting tool a hub module into place for mounting to the previously mounted generator front end.

Since the load is generally suspended from a single point (the hook of a crane), the inventive lifting assembly preferably also comprises two tag line booms, one at each end of the lifting beam. An operator can adjust the length of tag wires connected to the outer ends of the booms in order to adjust the orientation of the lifting beam and the load during a lifting procedure.

A heavy load may also be irregular in shape so that it is difficult to identify the position of its centre of gravity in advance of a lifting procedure. Therefore, in a preferred embodiment of the invention, the lifting assembly comprising a lateral adjustment means arranged to allow a lateral displacement of the locking assembly along the lifting beam. By adjusting the position of the locking assembly along the lifting beam, the position of the load is also adjusted relative to the point of suspension (the crane hook), so that the load can be optimally positioned relative to the point of suspension. The orientation of load can also be adjusted to some extent by the suspension arrangement, which can comprise a number of cable loops extending between trunnions at either end of the lifting beam and passing over the crane hook. In a preferred embodiment of the invention, the suspension assembly comprises at least two such cable loops arranged to pass over a double hook, as will become clear from the diagrams.

BRIEF DESCRIPTION

Some of the embodiments will be described in detail, with references to the following Figures, wherein like designations denote like members, wherein.

DETAILED DESCRIPTION

In the diagrams, like numbers refer to like objects throughout. Objects in the diagrams are not necessarily drawn to scale.

Figure 1:
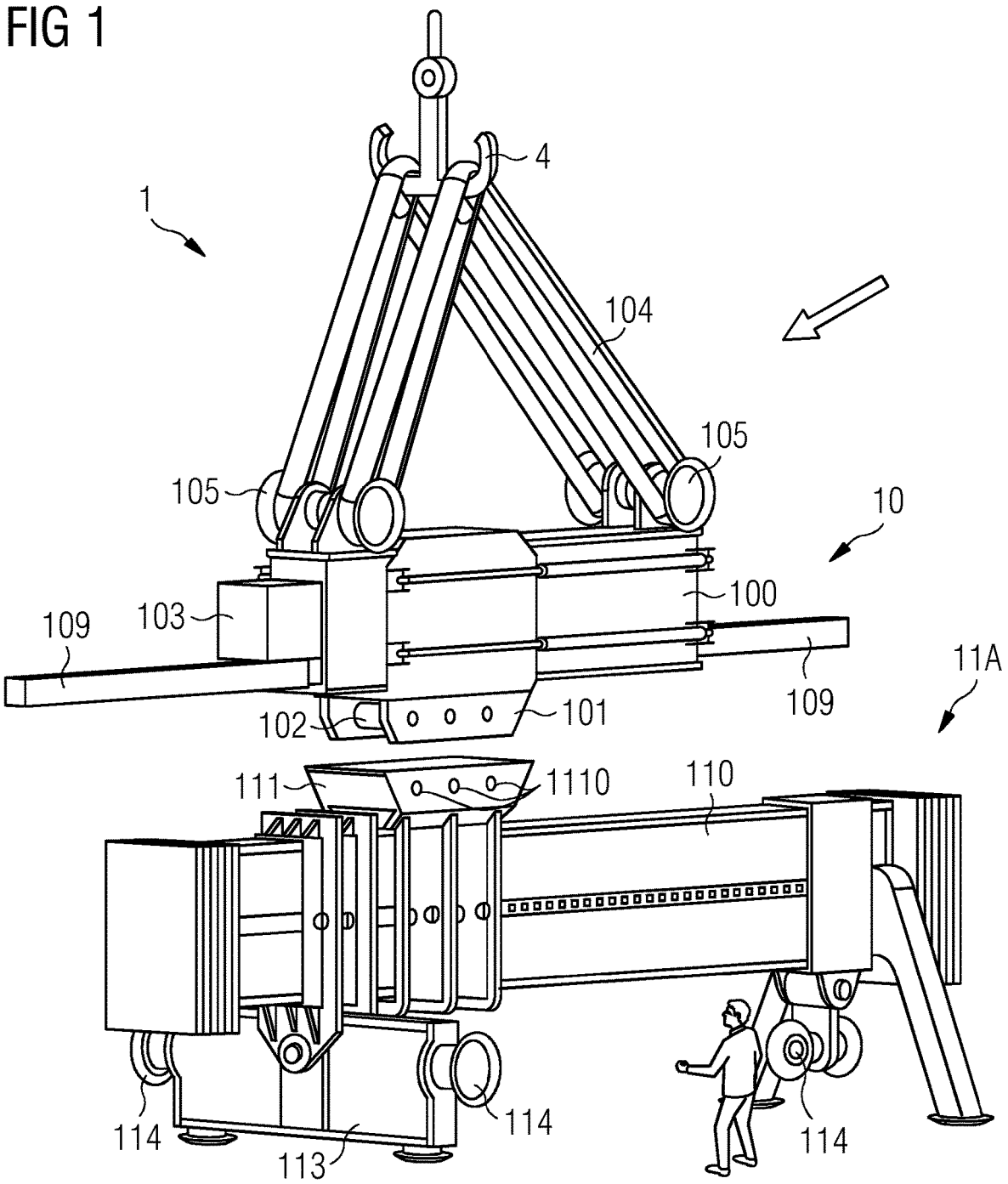
FIG. 1 shows an embodiment of the lifting assembly during a preparatory stage of a lifting manoeuvre.
Figure 2:
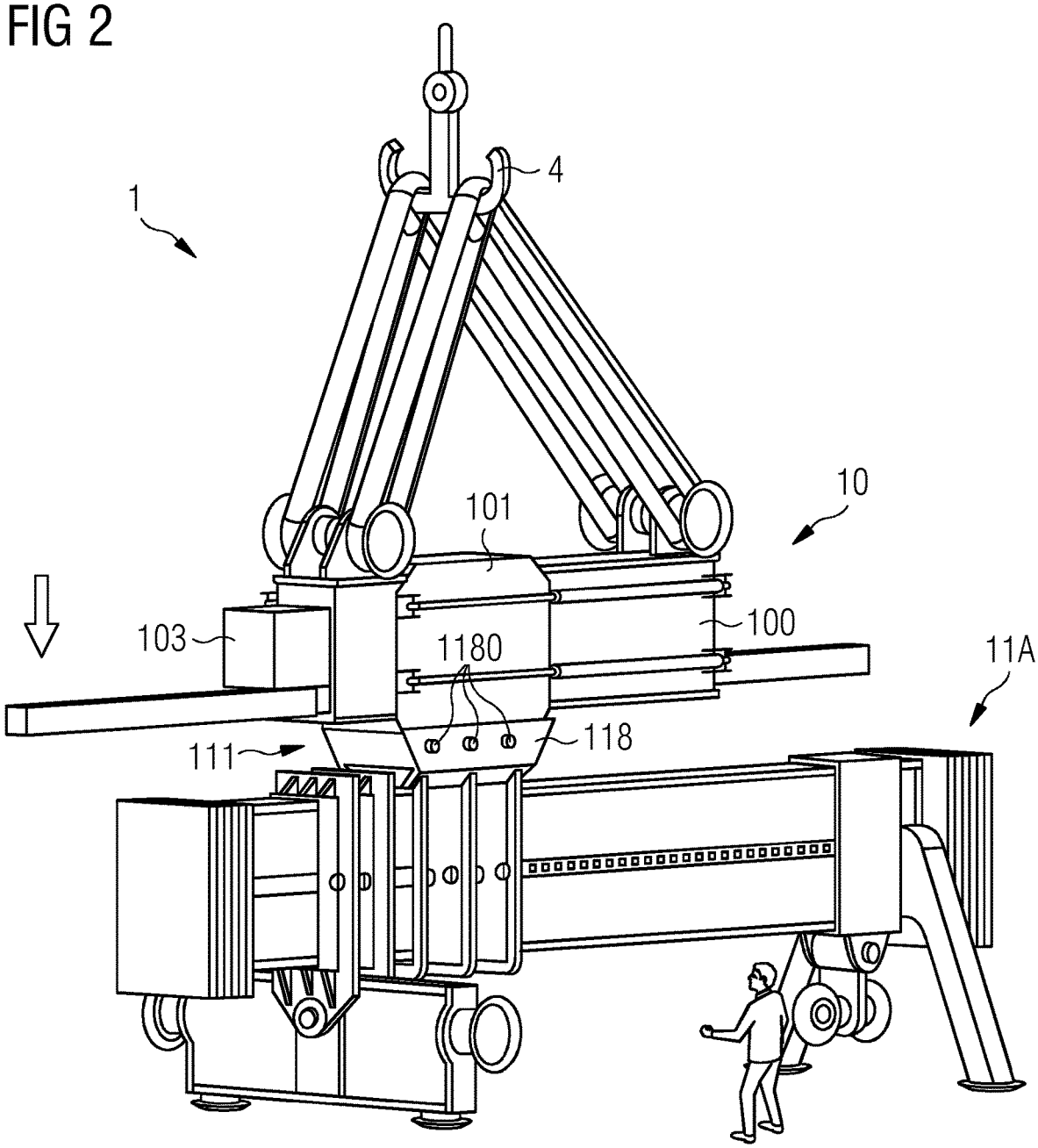
FIG. 2 shows an embodiment of the lifting assembly during a preparatory stage of the lifting manoeuvre.
Figure 3:
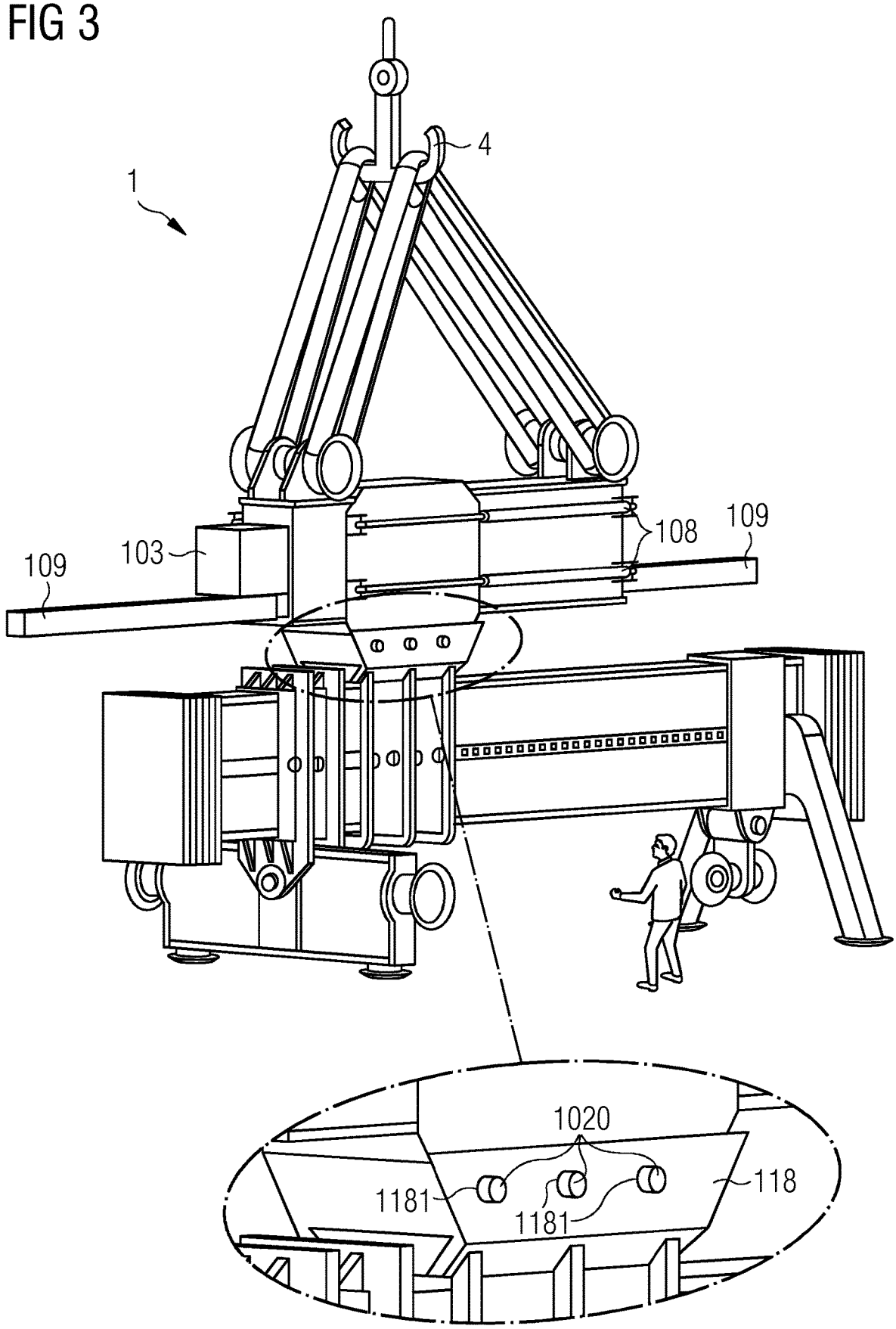
FIG. 3 shows an embodiment of the lifting assembly during a preparatory stage of a lifting manoeuvre.

FIG. 1 shows an embodiment of the inventive lifting assembly 1 in a first preparatory stage of a lifting manoeuvre. FIGS. 2 and 3 show further preparatory stages. The diagrams show the upper part 10 of the lifting assembly 1 suspended from the hook 4 of a crane (not shown) by means of the suspension arrangement which in this case comprises a heavy-duty arrangement of cables 104 and trunnions 105. In this embodiment, the lifting beam arrangement comprises a steel beam 100 to which four trunnions 105 are mounted for connection to the cables 104 of the suspension arrangement.

One of several lower parts of the lifting assembly 1 is shown in place underneath the upper part 10. In this exemplary embodiment, the lower part 11A is intended for use in lifting a nacelle unit, and comprises various load attachment means 113, 114 which will be illustrated with the aid of FIG. 8 below.

The lower part 11A will be locked to the upper part 10 prior to the lifting manoeuvre. To this end, the upper part 10 is equipped with a locking assembly 101, and the lower part 11A is equipped with a locking interface 111. In this embodiment, the locking assembly 101 comprises a hydraulic cylinder unit 102 with a horizontal arrangement of several hydraulic cylinders driven by a motor 103 mounted to the lifting beam 100 of the upper part 10, and the locking interface 111 comprises a pair of vertical side plates 118, each with a corresponding arrangement of through-holes. In FIG. 1, the upper part 10 is being brought into position (as indicated by the arrow) so that the locking assembly 101 can be lowered into the locking interface 111. This can be performed by remote control, and the diagrams indicate a technician observing the procedure and issuing control commands from a handheld remote control unit.

Initially, the pistons of the hydraulic unit 102 are fully retracted, so their outer ends do not protrude from side plates of the locking assembly 101. In FIG. 2, the locking assembly 101 is lowered into the locking interface 111 (as indicated by the arrow) so that the hydraulic cylinder arrangement 102 is contained between the side plates 118 of the locking interface 111.

FIG. 3 shows a final stage in the locking procedure. Here, the hydraulic cylinders have been actuated so that pistons 1020 extend and protrude through the through-holes 1181 in the side plates 118 of the locking interface 111. This is shown in the enlarged detail at the right-hand side of the diagram. The step of actuating the hydraulic cylinder unit 102 can also be performed by remote control, as will be known to the skilled person. The lifting assembly 1 is now ready for use: the tool attachments of the lower part 11A can be connected to the load, and the lifting assembly 1 together with its load can be hoisted into the air by the crane. FIGS. 1-3 also indicate two tag line booms 109 extending outward from either end of the lifting beam 100. Tag wires (not shown) can be secured to the outer ends of the tag line booms 109 and used to control any sideways movement of the load during a lifting manoeuvre. The diagrams also show a linear displacement means, realized using a pair of hydraulic cylinders 107 mounted horizontally to the vertical outer faces of the lifting beam 100. These hydraulic cylinders 107 can be actuated at any stage prior to or during a lifting manoeuvre to retract or extend their pistons in order to adjust the position of the locking assembly 101 along the lifting beam 100.

Figure 4:
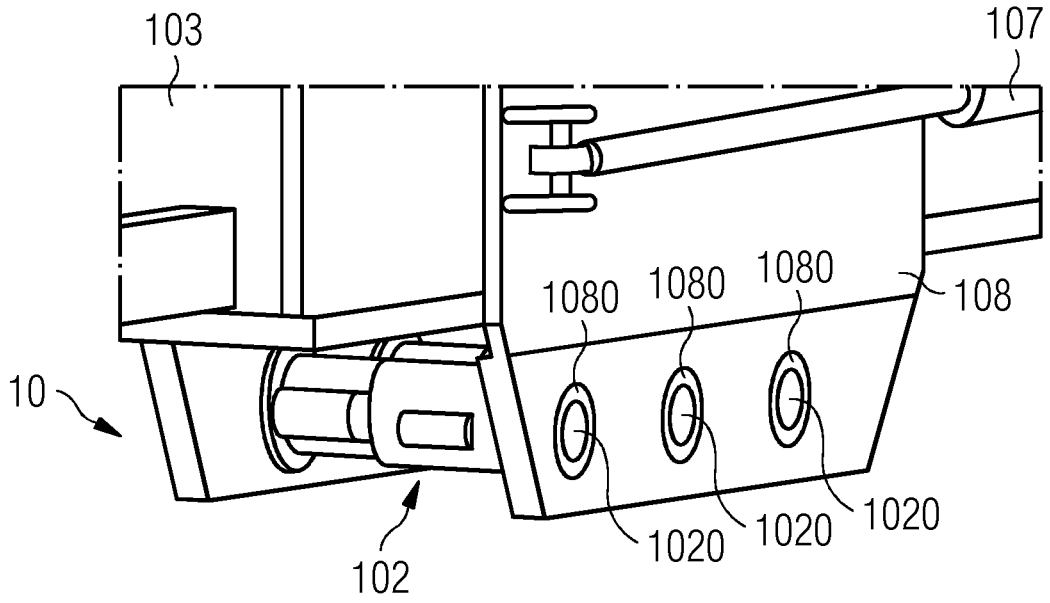
FIG. 4 shows a detail of the lifting assembly of FIGS. 1-3 with the actuators of the actuator arrangement in a retracted position.

FIG. 4 shows a detail of the upper part 10, showing the locking assembly 101. Here, the pistons 1020 of the hydraulic cylinder unit 102 are in a fully retracted position. In this position, the outer faces of the pistons 1020 lie flush with the outer faces of the side walls 108 of the locking assembly 101. Precisely machined bushings 1080 in the side walls 108 provide support for the pistons 1020 at all times. In this embodiment, the bushings 1080 are set into larger through-holes in the side walls 108 of the locking assembly 101. The inner surfaces of the bushings 1080 can be lined with a low-friction material such as PTFE to enable a smooth motion of the pistons 1020.

Figure 5:
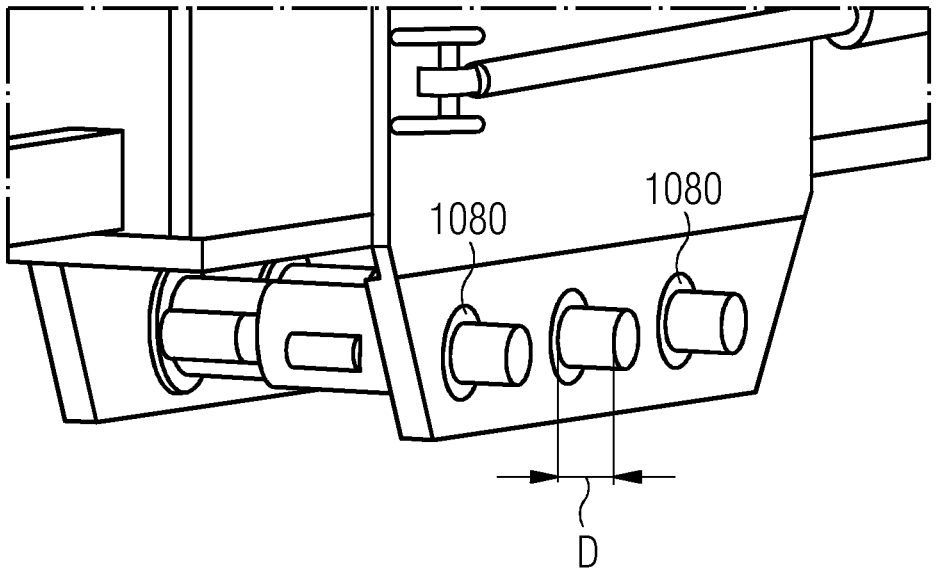
FIG. 5 shows a detail of the lifting assembly of FIGS. 1-3 with the actuators of the actuator arrangement in an extended position.

FIG. 5 shows a further detail of the upper part 10, showing the locking assembly 101 with the pistons 1020 of the hydraulic cylinder unit 102 in a fully extended position. In this position, the pistons 1020 protrude beyond the outer faces of the side walls 108 of the locking assembly 101 by a distance D that is sufficient to accommodate the thickness of the side plates 118 of the locking interface 111 of a lower part as described for example in FIGS. 1-3 above.

Figure 6:
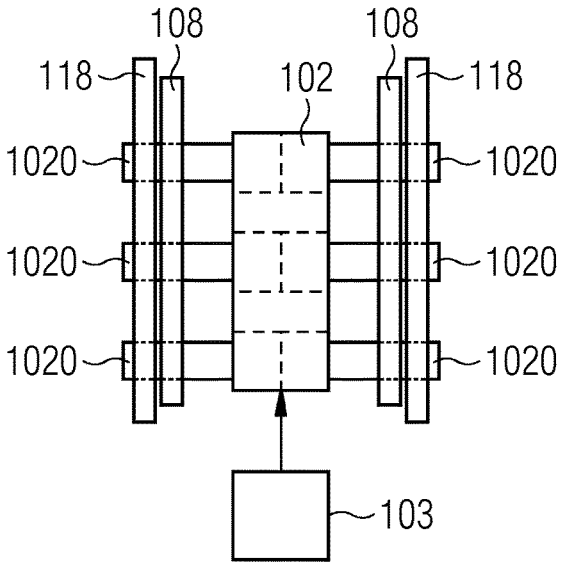
FIG. 6 shows a simplified view of a locking assembly and locking interface in another embodiment of the lifting assembly.

FIG. 6 shows a simplified view of a locking assembly 101 and locking interface 111, looking "into" the locking interface from above, for example. The diagram shows these parts in their locked state after issuing an appropriate control command sequence to the driver 103 or motor 103 of the hydraulic unit 102. Pistons 1020 of a six-cylinder hydraulic unit 102 have been extended through matching through-holes 1080, 1180 in the side walls 108, 118 of the locking assembly 101 and locking interface 111. In this embodiment, three hydraulic cylinders on the left-hand side are arranged in line with three hydraulic cylinders on the right-hand side. To detach the locking interface 111 from the locking assembly 101, an appropriate control command sequence is sent to the driver 103, for example via remote control, to make it retract the pistons 1020 of the hydraulic cylinder unit.

Figure 7:
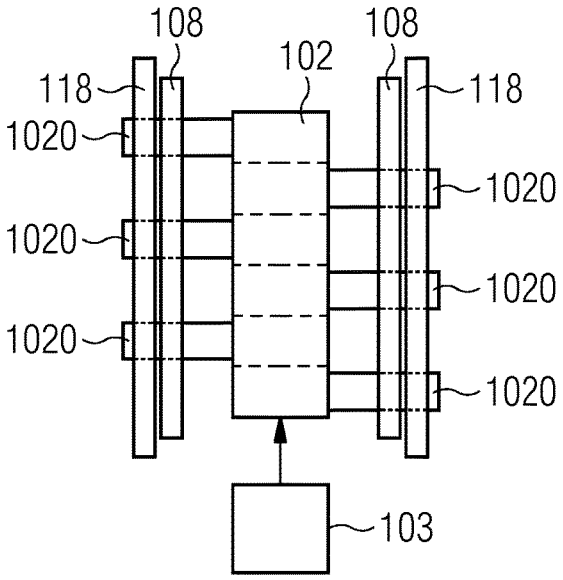
FIG. 7 shows a simplified view of a locking assembly and locking interface in another embodiment of the lifting assembly.

FIG. 7 shows a similar arrangement using a six-cylinder hydraulic unit 102, but in this case the cylinders are arranged in a staggered fashion. This allows a more compact construction of the locking assembly 101 and therefore also a more compact construction of the locking interface 111.

Figure 8:
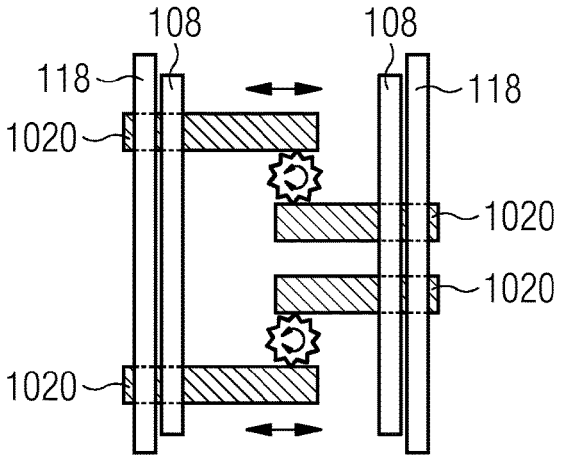
FIG. 8 shows a simplified view of a locking assembly and locking interface in another embodiment of the lifting assembly.

FIG. 8 shows an alternative embodiment of the locking assembly 101, which in this case uses a worm gear arrangement to laterally extend rods 1020 through the matching through-holes 1080, 1180 in the side walls 108, 118 of the locking assembly 101 and locking interface 111 in order to lock the lifting beam to a lifting tool, and to laterally retract the rods 1020 in order to release the lifting tool from the lifting beam.

Figure 9:
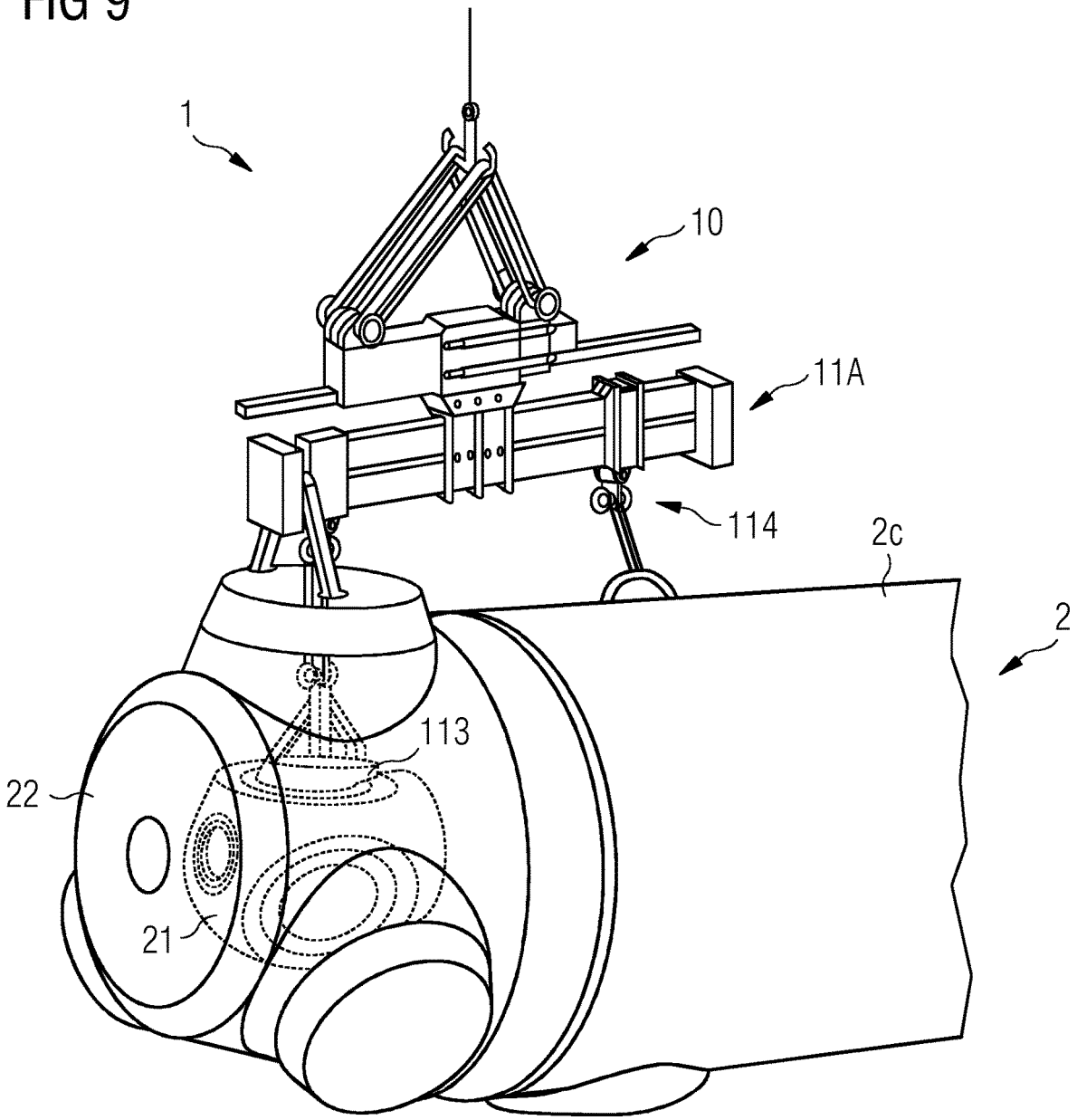
FIG. 9 shows the lifting assembly of FIGS. 1-3 during a lifting manoeuvre.

FIG. 9 shows the lifting assembly of FIGS. 1-3 in use during a lifting manoeuvre. Here, the load 2 is a wind turbine nacelle unit comprising a nacelle 20, hub 21 and spinner 22. The lower part 11A has tool attachments for engaging with the hub 21. As shown in the diagram, a hub tool attachment 113 is realized to extend through a blade opening in the spinner 22, so that it can be securely fastened to the hub 21. A further tool attachment 114 is secured in some suitable way to the nacelle 20.

Figure 10:
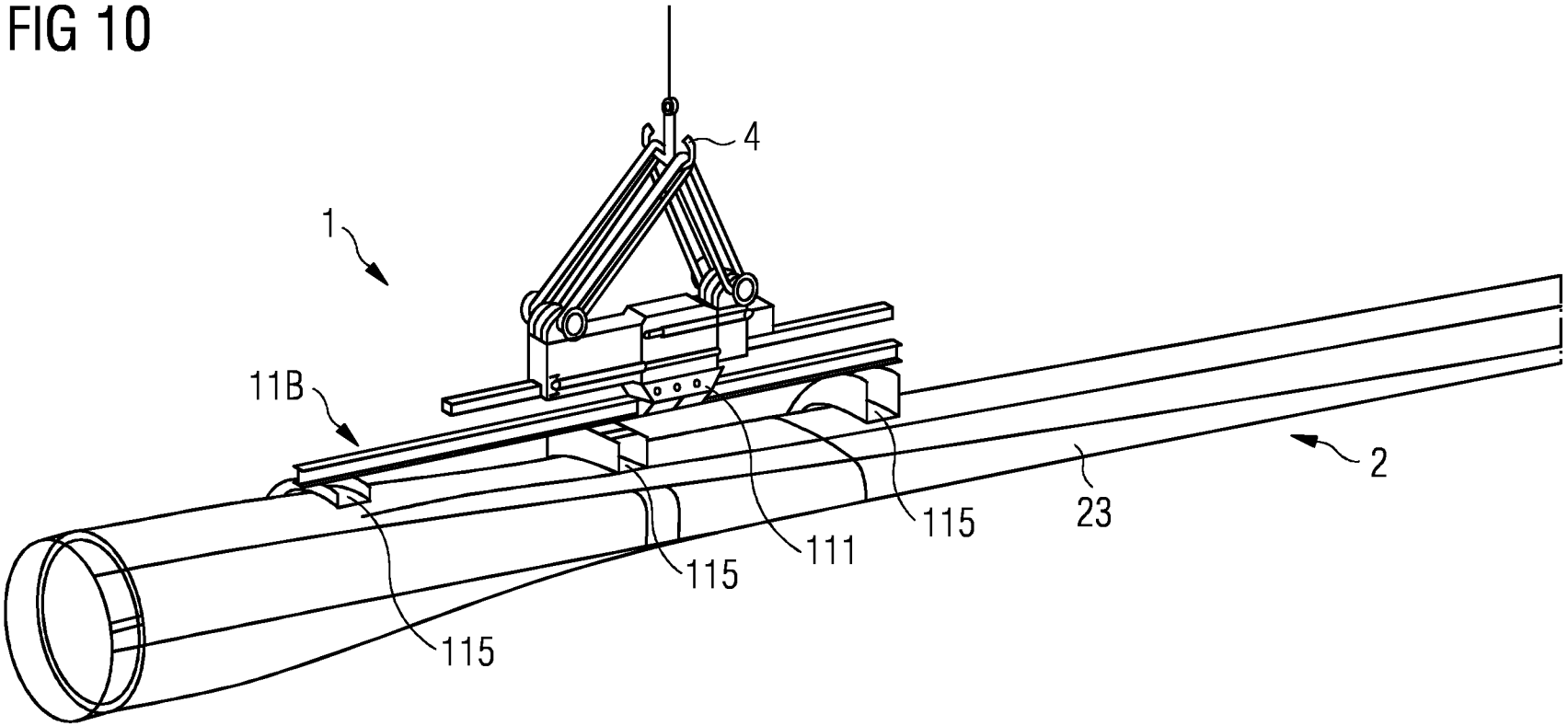
FIG. 10 shows a further embodiment of the lifting assembly during a lifting manoeuvre.

FIG. 10 shows a further embodiment of the inventive lifting assembly 1, in this case with a lower part 11B that has lifting tool attachments 115 designed to attach to a load 2 such as a wind turbine rotor blade 23 (shown partially in the diagram). Here also, the lower part 11B has a locking interface 111 as described in FIGS. 1-8 above to engage with the locking assembly 101 of the upper part 10.

Figure 11:
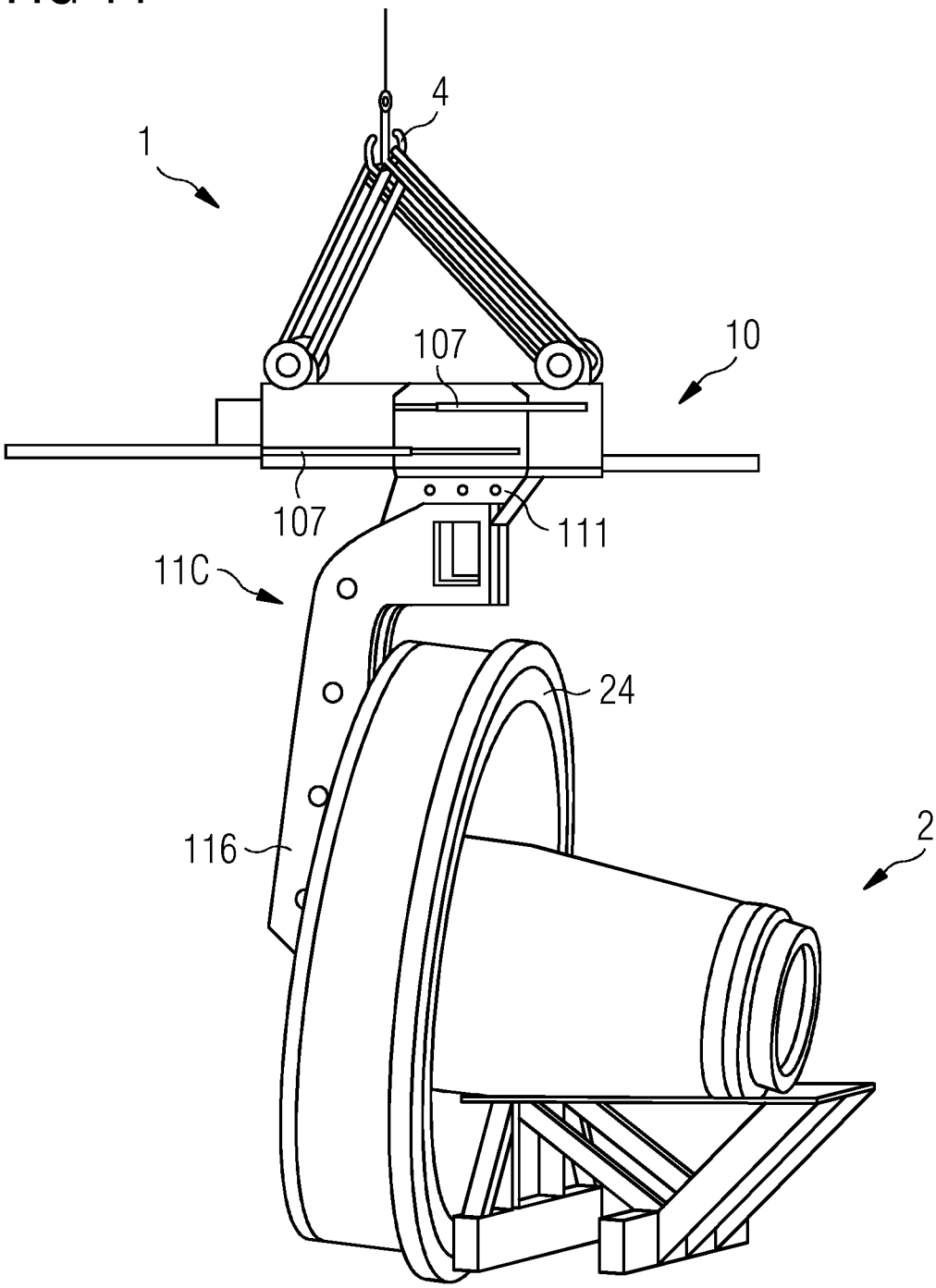
FIG. 11 shows a further embodiment of the lifting assembly during a lifting manoeuvre.

FIG. 11 shows a further embodiment of the inventive lifting assembly 1, in this case with a lower part 11C that has a lifting tool attachment 116 designed to attach to a load 2 such as the generator assembly 24 of a wind turbine (the assembly 24 is shown resting on a support structure). Here also, the lower part 11C has a locking interface 111 as described in FIGS. 1-8 above to engage with the locking assembly 101 of the upper part 10. This embodiment of the inventive lifting assembly 1 can be used to lift the generator assembly 24 into place when assembling the nacelle unit of FIG. 10, for example. In this embodiment, an arrangement of two opposing hydraulic cylinder modules 107 on the upper part allows a linear displacement of the locking assembly 1001 along the lifting beam 100.

Although the present embodiment of the invention has been disclosed in the form of preferred embodiments and variations thereon, it will be understood that numerous additional modifications and variations could be made thereto without departing from the scope of the embodiment of the invention. For example, although the lifting assembly has been described in the context of lifting different types of load during the installation or assembly of a wind turbine, it is clear that the lifting assembly could be used for lifting any kind of heavy load in any kind of construction project e.g. wind turbine towers, wind turbine hubs, offshore wind turbine foundations, transition pieces, tools etc.

Although the invention has been illustrated and described in greater detail with reference to the preferred exemplary embodiment, the invention is not limited to the examples disclosed, and further variations can be inferred by a person skilled in the art, without departing from the scope of protection of the invention.

For the sake of clarity, it is to be understood that the use of "a" or "an" throughout this application does not exclude a plurality, and "comprising" does not exclude other steps or elements.

The invention claimed is:

1. A lifting assembly for lifting a load, comprising an upper part and a number of independent lower parts, wherein:

the upper part comprises a lifting beam, a suspension arrangement for suspending the lifting beam from a crane hook, and a locking assembly comprising an actuator arrangement configured to engage the upper part to a lower part; and the lower part comprises a lifting tool configured for connection to a load, and a locking interface configured to engage with the locking assembly of the upper part;

wherein the locking interfaces of the plurality of lower parts are all constructed in an identical fashion;

wherein the actuator arrangement comprises a number of linear actuators, and wherein the locking interface is configured to engage with the linear actuators.

2. The lifting assembly according to claim 1, wherein the actuator arrangement comprises a number of linear actuators arranged to extend horizontally in a first direction, and a number of linear actuators arranged to extend horizontally in a second direction that is opposite to the first direction.

3. The lifting assembly according to claim 1, wherein the locking assembly is mounted to the lifting beam and comprises side plates arranged to contain the actuator arrangement, further wherein the side plates comprise through-holes arranged to accommodate linear actuators of the actuator arrangement.

4. The lifting assembly according to claim 3, wherein the locking interface comprises side plates arranged to accommodate the locking assembly, further wherein the side plates comprise through-holes arranged to match the through-holes of the locking assembly and to accommodate the linear actuators.

5. The lifting assembly according to claim 1, wherein the actuator arrangement comprises a hydraulic cylinder unit, and wherein a linear actuator is a piston rod of the hydraulic cylinder unit.

6. The lifting assembly according to claim 1, wherein a lower part is configured for connection to a wind turbine nacelle unit.

7. The lifting assembly according to claim 1, wherein a lower part is configured for connection to a wind turbine rotor blade.

8. The lifting assembly according to claim 1, wherein a lower part is configured for connection to a wind turbine generator front end.

9. The lifting assembly according to claim 1, comprising a driver module arranged to drive the actuator arrangement in response to a control signal received from a remote control unit.

10. The lifting assembly according to claim 1, comprising a lateral adjustment means arranged to allow a lateral displacement of the locking assembly along the lifting beam.

11. A method of lifting a load using a lifting assembly according to claim 1, the method comprising:

selecting a lower part according to the load to be lifted;

engaging the locking interface of the lower part to the locking assembly of the upper part;

connecting a lifting tool of the lower part to the load;

attaching the suspension arrangement of the upper part to a crane hook; and raising the crane hook to lift the load.

12. The method according to claim 11, comprising a step of determining a position of the locking assembly on the lifting beam on a basis of a weight and/or dimensions of the load to be lifted.

* * * * *